US006260738B1

(12) United States Patent
Kerr et al.

(10) Patent No.: US 6,260,738 B1
(45) Date of Patent: Jul. 17, 2001

(54) NOZZLE HAVING UPWARD MOVING STRAW WHILE COMMUNICATING UPRIGHT DISPENSING

(75) Inventors: George Scott Kerr, Mason; John Allen Wooton, New Richmond; Jennifer Sue Dwyer; Charlene Marie Stevenot, both of Cincinnati, all of OH (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 09/591,905

(22) Filed: Jun. 12, 2000

Related U.S. Application Data

(60) Provisional application No. 60/139,164, filed on Jun. 15, 1999.

(51) Int. Cl.[7] ..... B65D 83/20
(52) U.S. Cl. ..... 222/402.13
(58) Field of Search ..... 222/527, 509, 222/402.13

(56) References Cited

U.S. PATENT DOCUMENTS

| | | | | |
|---|---|---|---|---|
| 2,819,116 | | 1/1958 | Abplanalp | 299/95 |
| 2,921,722 | * | 1/1960 | Focht | 222/403.13 |
| 2,981,446 | | 4/1961 | Campbell | 222/394 |
| 3,101,876 | | 8/1963 | Ayres | 222/394 |
| 3,116,856 | | 1/1964 | Prussin et al. | 222/394 |
| 3,143,254 | | 8/1964 | Vanderhyde | 222/394 |
| 3,148,806 | | 9/1964 | Meshberg | 222/394 |
| 3,169,672 | | 2/1965 | Soffer et al. | 222/153 |
| 3,314,576 | | 4/1967 | Focht et al. | 222/402.13 |
| 3,323,695 | | 6/1967 | Monahon | 222/506 |
| 3,464,597 | * | 9/1969 | Kutik | 222/529 |
| 3,567,081 | | 3/1971 | Meshberg | 222/402.17 |
| 3,692,215 | | 9/1972 | Nigro | 222/402.21 |
| 4,068,782 | * | 1/1978 | Van Der Heijden | 222/402.13 |
| 4,219,135 | | 8/1980 | Ufferflige | 222/402.13 |
| 4,775,081 | | 10/1988 | Morane | 222/402.13 |
| 5,018,647 | * | 5/1991 | Abplanalf | 222/402.13 X |
| 5,154,323 | | 10/1992 | Query et al. | 222/153 |
| 5,501,375 | * | 3/1996 | Nilson | 222/402.13 |
| 5,597,095 | * | 1/1997 | Ferrara, Jr. | 222/403.13 X |
| 5,915,597 | * | 6/1999 | De Laforcade | 222/402.13 X |
| 6,056,160 | * | 5/2000 | Carlucci et al. | 222/402.13 X |
| 6,089,410 | * | 7/2000 | Ponton | 222/402.13 X |
| 6,145,704 | * | 11/2000 | Geier | 222/402.13 X |

FOREIGN PATENT DOCUMENTS

| | | | |
|---|---|---|---|
| 570204 | 12/1975 | (CH) | B05B/1/00 |
| 2324144 | 11/1974 | (DE) | B05B/1/00 |
| 1359152 | 7/1974 | (GB) | B65D/1/02 |

* cited by examiner

*Primary Examiner*—Kenneth Bomberg
(74) *Attorney, Agent, or Firm*—Jack L. Oney, Jr.

(57) ABSTRACT

A nozzle for dispensing packages which clearly communicates the function of upright dispensing and encourages a proper usage angle to insure substantial product evacuation from the package while functionally minimizing the risk of product being dispensed onto the side of the package is provided. The nozzle has a dispensing straw which is hinged at the underneath side of a shroud. The dispensing straw and shroud may be constructed as a single part.

6 Claims, 3 Drawing Sheets

NOZZLE HAVING UPWARD MOVING STRAW WHILE COMMUNICATING UPRIGHT DISPENSING

CROSS-REFERENCE TO RELATED APPLICATION

This application is a non-provisional filing of our earlier provisional application, U.S. Ser. No. 60/139,164, filed Jun. 15, 1999.

TECHNICAL FIELD OF THE INVENTION

The present invention relates in general to a nozzle for dispensing packages which clearly communicates the function of upright dispensing and encourages a proper usage angle to insure substantial product evacuation from the package while functionally minimizing the risk of product being dispensed onto the side of the package.

BACKGROUND OF THE INVENTION

Various consumer products are packaged and dispensed from a variety of packages. One such package is an aerosol package which uses propellant to move product through a stem which is inserted into the product container body. Functionally, there are two types of actuator designs for these aerosol packages, these being upright and inverted designs. An upright actuator design is designed to dispense product while the container body is angled less than 90° degrees from vertical. An inverted actuator design is designed to dispense while the container body is angled more than 90° from vertical and most often completely upside-down (i.e.: 180° from vertical). Upright actuators are preferred by some consumers over inverted actuators dispensing because of better ergonomics and ease of use. However, current upright actuators tend to have increased messiness due to product being accidentally dispensed on the side of the primary package.

One current approach to solving this problem is a nozzle design which appears to direct product at 90° from the side of the package, but in actuality have nozzle hinges which flex the dispensing straw away from the side of the package. This approach fails because the consumer (ie: user) can visually see the flex or movement of the dispensing straw during product dispensing and responds by adjusting the package dispensing angle causing package misuse (ie: dispensing at an angle greater than 90° from vertical).

Another current approach is to solving this problem is a nozzle design consisting of a fixed dispensing straw position to maintain dispensing angle, but which requires the consumer to flex or bend the dispensing straw during dispensing. This approach fails because the design of the dispensing straw is too constrained (e.g. limited diameter size), thus negatively affecting final product characteristics, increasing the necessary actuation force, and limiting selection of material construction.

Sometimes when aerosol packages are misused (e.g. improper dispensing angle), too much propellant is dispersed. This alters the ratio of remaining product-propellant mixture and compromises product performance. Eventually as excess propellant is improperly dispensed from the package, an unacceptable level of residual product remains in the package.

What is needed is a nozzle for dispensing packages which clearly communicates the function of upright dispensing and encourages a proper usage angle to insure substantial product evacuation from the package while functionally minimizing the risk of product being dispensed onto the side of the package.

SUMMARY OF THE INVENTION

The present invention is directed to a nozzle for dispensing packages which clearly communicates the function of upright dispensing and encourages a proper usage angle to insure substantial product evacuation from the package while functionally minimizing the risk of product being dispensed onto the side of the package. One embodiment of this nozzle design provides a dispensing straw which is hinged at the underneath side of a shroud. Additionally, this nozzle design permits the construction of a single part.

These and other features and advantages of the present invention will be apparent to those of ordinary skill in the art in view of the detailed description of the preferred embodiment which is made with reference to the drawings, a brief description of which is provided below.

DETAILED DESCRIPTION OF THE PREFERRED EMBODIMENTS

Reference will now be made in detail to the present preferred embodiment of the invention, examples of which are illustrated in the accompanying drawings wherein like numerals indicate the same elements throughout the views. As discussed more fully hereafter, the present invention is, in its most preferred form, directed to a nozzle for dispensing packages (e.g. aerosol packages) which clearly communicates the function of upright dispensing and encourages a proper usage angle to insure substantial product evacuation from the package while functionally minimizing the risk of product being dispensed onto the side of the package. While the present invention is discussed herein with respect to a nozzle having a dispensing straw which is hinged at the underneath side of a shroud for purposes of simplicity and clarity, it will be understood that the present invention can be used and constructed using other design techniques.

Figure 1:
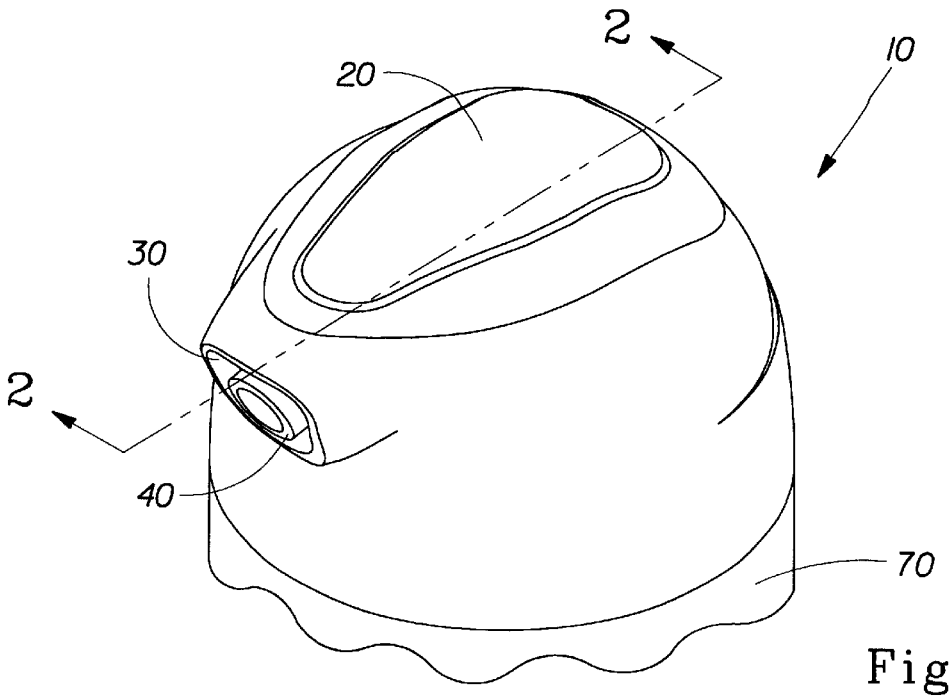
FIG. 1 is a perspective view of a nozzle encompassing the present invention.
Figure 2:
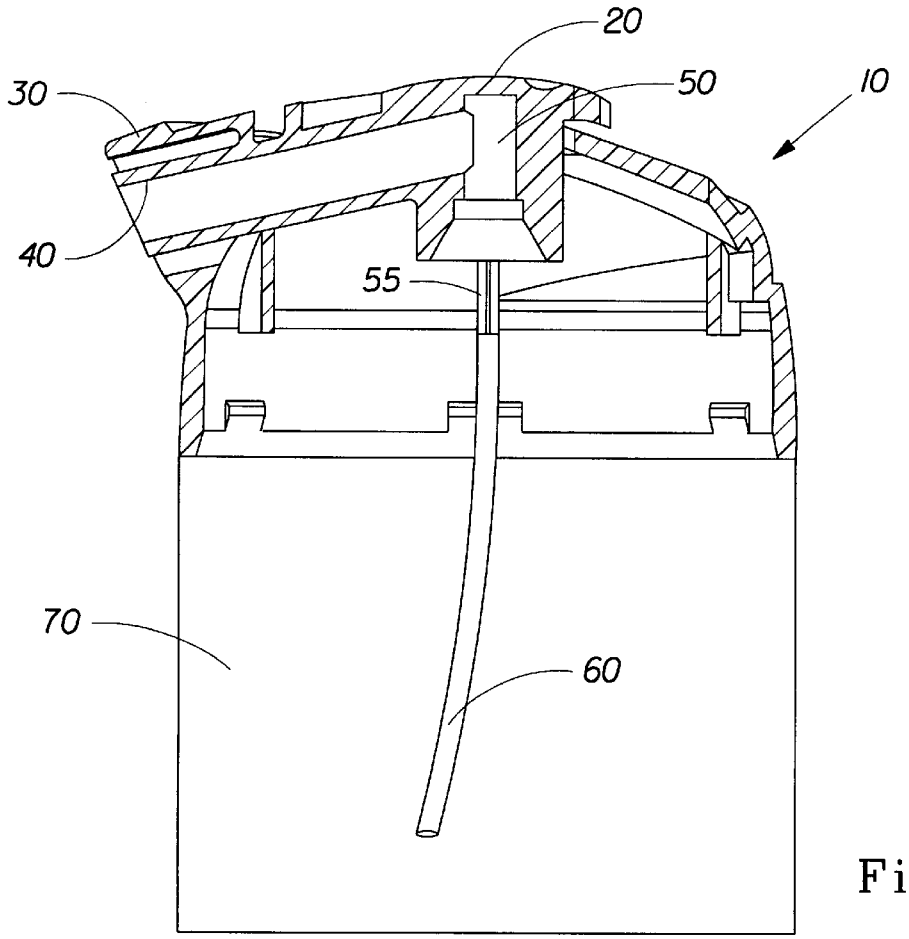
FIG. 2 is a cross-sectional view of a package containing the nozzle within FIG. 1.

Referring to FIGS. 1 and 2, a particularly preferred package 10 made in accordance with the present invention is illustrated. The package 10 comprises an actuating button 20, a shroud 30 and a dispensing straw 40. Additionally, package 10 comprises standard elements of a actuator 50, valve 55, stem 60 and a container body 70. Although recitation of these package elements may be necessary for discussion purposes, they are not a significant part of the essence of the present invention.

Figure 3:
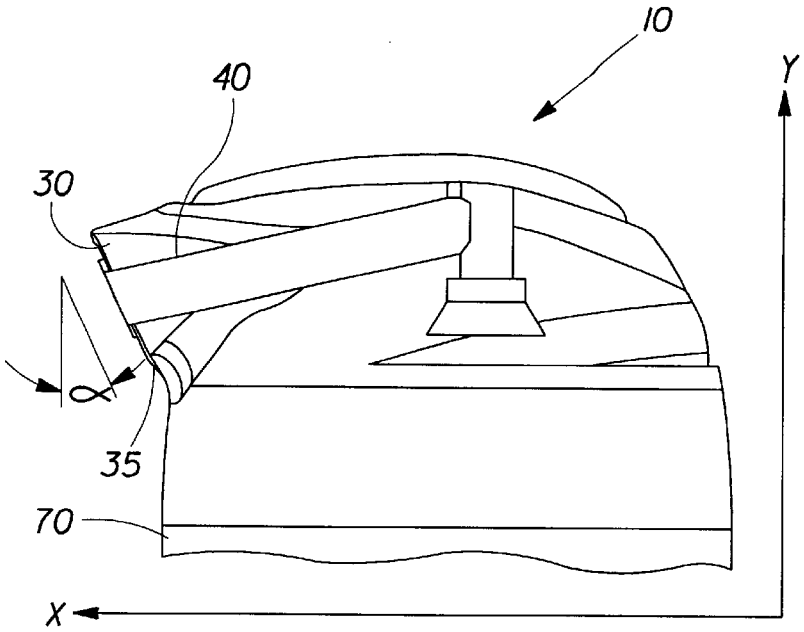
FIG. 3 is a cross-sectional view of the nozzle within FIG. 1 in a non-actuated state.

Referring to FIG. 3, package 10 is shown in an upright position as would be found when resting on a store shelf or a consumer counter. Shroud 30 is a attached to canister body 70 and is substantially immovable in that shroud 30 remains in substantially the same orientation to canister body 70 (ie: when canister body 70 is tilted, shroud 30 tilts respectively). The exit surface 35 of shroud 30 is proximate to dispensing straw 40 and is angled downwardly and/or inwardly at an angle depicted as "α". In one embodiment of the presentation invention, angle α is preferably from about 5° to about 85°, and most preferably 13°. Such angle orientation of exit surface 35 will be further emphasized later.

Figure 4:
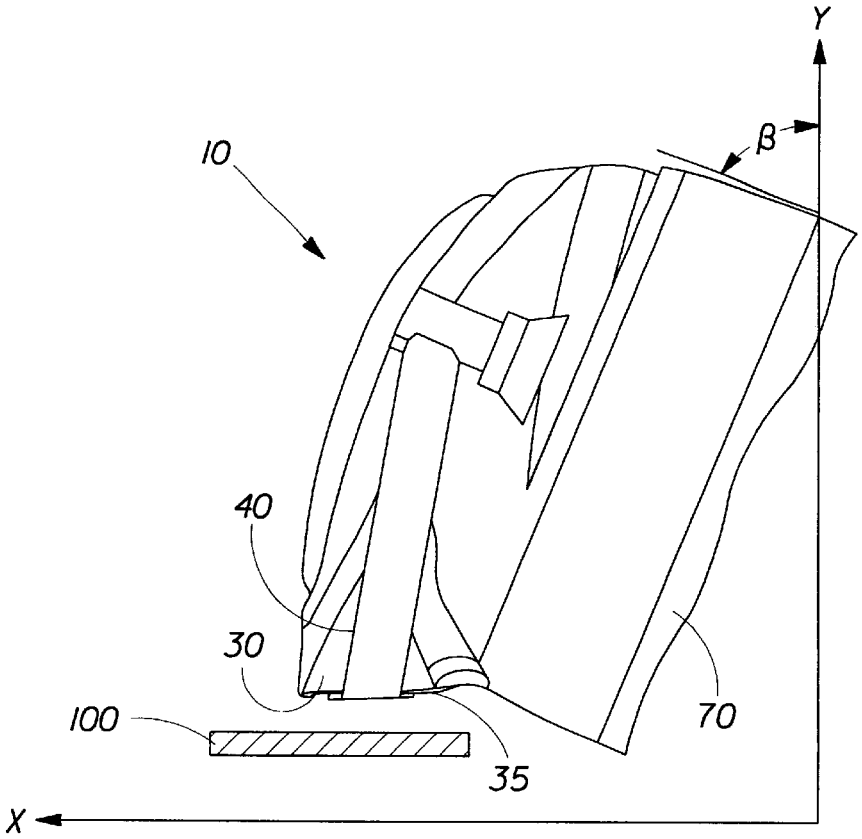
FIG. 4 is a cross-sectional view of the nozzle within FIG. 1 in a non-actuated state but oriented such that the shroud is parallel to the target surface.

Referring to FIG. 4, it has been discovered that consumers rotate or tilt package 10 during dispensing such that the exit surface 35, or exiting orifice of straw 40 when no shroud is used, such that said surface is parallel to a target surface 100 (e.g. consumer's hand). In recognition of this discovery, exit surface 35 was angled at α in order to achieve a corresponding package dispensing angle "β". For example, if exit surface angle α is designed at 13°, then the package dispensing angle β will equal 77°. It has been discovered that many dispensing packages, particularly those packages with a stem 60, have an optimum dispensing angle preferably from about 65° to about 85°, and most preferably 77° such that the amount of residual product (ie: product not dispensed) in package 10 is minimized.

Some packages in the prior art have attempted to provide a straw 40 at such an angle α in order to achieve an optimal package dispensing angle β; however, most straws in the prior art pivot such that their movement is significantly noticeable to the consumer. As such, when the straw 40 pivots in either direction, the consumer typically rotates package 10 in such a way to maintain a parallel orientation between target surface 100 and the exiting orifice of the straw 40. Once the consumer rotates package 10, the optimal package dispensing angle β is no longer maintained. Other packages in the prior art attempt to provide a straw 40 which does not rotate during dispensing in order to maintain angles α and β; however, these packages fail because the product being dispensed will usually come in contact with the outer wall of the canister body 70 causing the package 10 to become messy. To overcome this second problem, the prior art teaches the lengthening of straw 40, however, this creates another problem of increasing the footprint (ie: largest cross-sectional perimeter of the package) thus creating shelving problems and/or making the straw 40 more prone to breakage.

Figure 5:
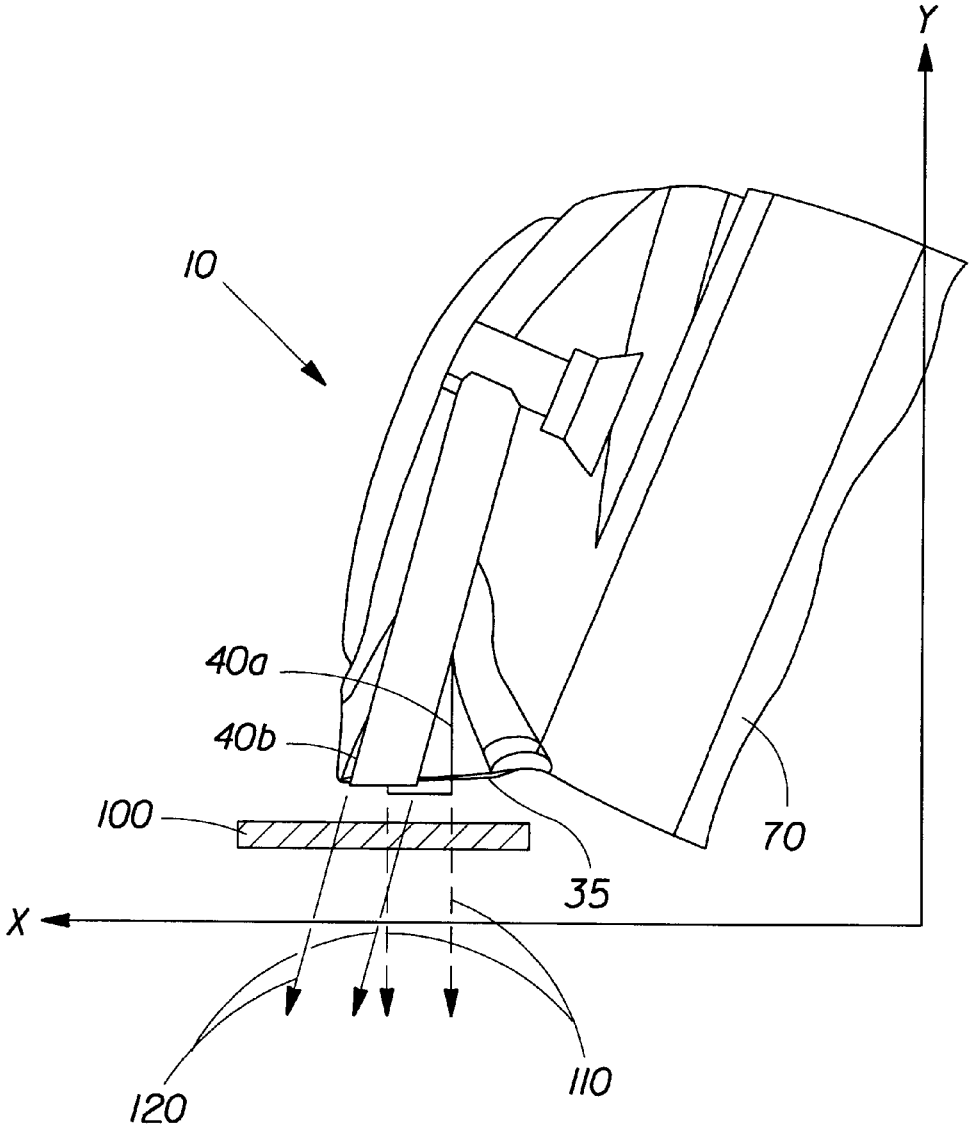
FIG. 5 is a cross-sectional view of the nozzle within FIG. 1 in an actuated state and oriented such that the shroud is parallel to the target surface.

Referring now to FIGS. 2 and 5, the present invention provides for shroud 30 which substantially hides from the view of the consumer the rotation of straw 40. As such, the consumer will not adjust the orientation of package 10 thus preserving the proper package dispensing angle β. Furthermore, because straw 40 is hinged to the underneath surface of shroud 30, it rotates upwardly and away from the outer wall of canister body 70 thus reducing the amount of dispensed product which comes into contact with the outer wall of canister body 70. This improved result is illustrated in FIG. 5, wherein, projection lines 110 show the corresponding dispensing path of straw 40*a* in an un-rotated position and projection lines 120 show the corresponding dispensing path of straw 40*b* in a rotated position. Therefore, the nozzle of the present invention solves the compounded problems of achieving the proper package dispensing angle β while minimizing the amount of product which comes in contact with the outer wall of canister body 70. Furthermore, the nozzle of the present invention permits the construction of a single part containing both the shroud 30 and straw 40 (e.g. single shot molding process). Shroud 30 and straw 40 may be constructed using commonly known materials for such packages, including but not limited to, plastic. Additionally, actuating button 20 may be constructed using commonly known materials for such packages, including but not limited to, QST Monprene with a durometer from about 20 to about 25, Sanoprene with a durometer from about 20 to about 40, DMS elastomer with a durometer from about 20 to about 40 or Alpha Gary Evaprene with a durometer from about 20 to about 40.

The foregoing description of the preferred embodiment of the present invention has been presented for purposes of illustration and description. It is not intended to be exhaustive or to limit the invention to the precise form disclosed. Modifications or variations are possible and contemplated in light of the above teachings by those skilled in the art, and the embodiment discussed was chosen and described in order to best illustrate the principles of the invention and its practical application. It is intended that the scope of the invention be defined by the claims appended hereto.

What is claimed is:

1. A nozzle for dispensing packages which clearly communicates the function of upright dispensing and encourages a proper usage angle to insure substantial product evacuation from the package while functionally minimizing the risk of product being dispensed onto the side of the package, wherein said nozzle comprises:

a shroud, said shroud having a terminal end; and a dispensing straw, said straw having a terminal end which pivots relative to said terminal end of said shroud, said terminal end of said shroud and said terminal end of said straw terminating at substantially the same point, said straw pivots substantially underneath said shroud such that said pivoting action is substantially hidden in view of the user.

2. The nozzle according to claim 1, wherein said shroud has an exiting surface that is angled downwardly.

3. The nozzle according to claim 2, wherein said exiting surface is angled from about 5° to about 85°.

4. The nozzle according to claim 1, wherein said dispensing straw is hinged to the underneath surface of said shroud.

5. The nozzle according to claim 1, wherein said shroud and said straw are constructed as a single part.

6. The nozzle according to claim 3, wherein said exiting surface is angled at about 13°.

* * * * *